United States Patent [19]

Snell et al.

[11] 4,400,181

[45] Aug. 23, 1983

[54] METHOD FOR USING FAST FLUIDIZED BED DRY BOTTOM COAL GASIFICATION

[75] Inventors: George J. Snell, Fords; Paul H. Kydd, Lawrenceville, both of N.J.

[73] Assignee: Hydrocarbon Research, Inc., Lawrenceville, N.J.

[21] Appl. No.: 343,626

[22] Filed: Jan. 28, 1982

[51] Int. Cl.[3] ..... C10J 3/00

[52] U.S. Cl. ..... 48/197 R; 48/62 R; 48/63; 48/203; 48/206

[58] Field of Search ..... 48/197 R, 206, 202, 48/203, 62 R, 63, 73, 76, 77

[56] References Cited

U.S. PATENT DOCUMENTS

| | | | |
|---|---|---|---|
| 3,840,353 | 10/1974 | Squires | 48/203 |
| 3,847,563 | 11/1974 | Archer et al. | 48/77 |
| 3,876,392 | 4/1975 | Kalina et al. | 48/210 |
| 4,032,305 | 6/1977 | Squires | 48/73 |
| 4,077,778 | 3/1978 | Nahas et al. | 48/202 |
| 4,312,638 | 1/1982 | Koump | 48/197 R |

*Primary Examiner*—Robert L. Lindsay, Jr.

*Attorney, Agent, or Firm*—V. A. Mallare; F. A. Wilson

[57] ABSTRACT

Carbonaceous solid material such as coal is gasified in a fast fluidized bed gasification system utilizing dual fluidized beds of hot char. The coal in particulate form is introduced along with oxygen-containing gas and steam into the fast fluidized bed gasification zone of a gasifier assembly wherein the upward superficial gas velocity exceeds about 5.0 ft/sec and temperature is 1500°-1850° F. The resulting effluent gas and substantial char are passed through a primary cyclone separator, from which char solids are returned to the fluidized bed. Gas from the primary cyclone separator is passed to a secondary cyclone separator, from which remaining fine char solids are returned through an injection nozzle together with additional steam and oxygen-containing gas to an oxidation zone located at the bottom of the gasifier, wherein the upward gas velocity ranges from about 3-15 ft/sec and is maintained at 1600°-200° F. temperature. This gasification arrangement provides for increased utilization of the secondary char material to produce higher overall carbon conversion and product yields in the process.

11 Claims, 2 Drawing Figures

METHOD FOR USING FAST FLUIDIZED BED DRY BOTTOM COAL GASIFICATION

BACKGROUND OF INVENTION

This invention pertains to an improved coal gasification process and apparatus using a fast fluidized bed gasifier assembly for producing low- and medium-Btu gas products. It pertains particularly to such gasification process wherein fine secondary char is returned to the gasifier's lower end.

The gasification of hydrocarbon solids such as coal or coke and residual oils using a fast fluidized bed of char particles at high superficial velocities and moderately high density has been previously proposed, as described in U.S. Pat. Nos. 3,840,353; 3,957,457 and 4,032,305 to Squires. Fast fluid beds are those fluidized beds operating in a fast fluidization contacting regime, and have characteristics of high superficial gas velocity, i.e.; five to ten fold higher than normal or conventional fluidized beds, and high solids circulation rates along with a high degree of solids backmixing. The fluidized bed density for a given solid is a function of the solids circulation rate as well as gas superficial velocity, and provides high heat and mass transfer rates. Steam and oxygen-containing gas are introduced into the lower portion of the bed to provide the fluidization and the reactants needed for gasification.

In previous experimental work on coal gasification using a fast fluidized bed process, fine char material from a secondary cyclone separator was removed but not recycled to the gasifier. Results indicated that less than about 50% of the carbon in the feed coal was converted to gases and liquid products using such a fast fluid bed gasifier configuration. Thus, improvements in char utilization for such coal gasification processes are clearly needed to produce higher conversion of carbon and improved yields of fuel gas products having low to medium heating values.

SUMMARY OF INVENTION

The present invention provides an improved gasification process and apparatus for carbonaceous solid materials such as coal, and utilizes a fast fluidized bed contacting regime and solids recycle steps for producing a fuel gas product having low to medium-Btu heating value. In the process the carbonaceous feed material is introduced into a gasification zone containing a fast fluidized bed of hot char particles. Steam and oxygen or an oxygen-containing gas are also introduced into the lower portion of the fast fluidized bed gasifier. The gas superficial velocity employed in the fast fluidized bed zone is greater than the individual particle terminal settling velocity and usually exceeds about 5 ft/sec. The coal particles are rapidly heated and devolatized in the bed to form gas, tar vapors and a substantial amount of partially reacted coal or char, along with carbon-steam and carbon-oxygen reactions to produce the fuel gas product.

The resulting gaseous material and char are passed to a primary gas-solids separator to remove from the effluent gas product entrained char solids, which are recycled via an enlarged conduit device to a lower portion of the fast fluidized bed for further gasification reaction. Gas from the primary solids separator and remaining fine char solids are passed to a secondary gas-solids separation step, from which a product gas stream is withdrawn. The remaining fine carbon or char solids are returned along with additional oxygen and steam to an oxidation zone located at the lower end of the fast fluidized bed gasifier for further gasification reaction. This secondary char recycle arrangement increases the carbon conversion and product gas yields derived from the carbonaceous feed material.

DESCRIPTION OF INVENTION

In the present invention, a particulate hydrocarbon material such as coal is fed into the gasifier through an annular or shrouded nozzle located in the lower portion of the gasification zone. The coal particles are intimately mixed with a bed of hot char therein which is maintained in a highly turbulent state of fast fluidization. The char to coal feed weight mixing ratios in the fluidized bed are at least about 20, and are usually 22–30, and such ratios are a consequence of the high solids (char) circulation rates associated with fast fluidized bed gasification processes. Steam and oxygen-containing gas are introduced into an oxidation zone located below the gasification zone and also containing a fluidized bed of hot char particles. Useful fast fluid bed gasification zone operating conditions for coal gasification are bed temperature in the range of 1500°–1850° F., superficial gas upward velocity of 5–20 ft/sec, and operating pressure of 2–50 atmospheres. At these conditions, individual coal particles undergo rapid heating and devolatilization in the gasification zone, which generates gases, tar vapors and substantial amounts of char. The tars are thermally cracked to produce light hydrocarbon gases, hydrogen, and carbon during their travel upward through the fast fluid bed zone, while a substantial portion of the char is recycled to the fluidized bed.

Unconverted steam from and carbon dioxide generated in the contiguous, communicating oxidation zone, located immediately below the fast fluid bed gasification zone, simultaneously react with the coal-derived char in the fast fluid bed gasification zone in accordance with equation (1) and (2), which are both endothermic reactions. The mildly exothermic CO shift reaction depicted symbolically in equation (3) is a third simultaneous reaction occurring in the fast fluid bed gasification zone.

$$C + H_2O \rightarrow H_2 + CO \text{ (endothermic)} \quad (1)$$

$$C + CO_2 \rightarrow 2CO \text{ (endothermic)} \quad (2)$$

$$CO + H_2O \rightarrow H_2 + CO_2 \text{ (mildly exothermic)} \quad (3)$$

From the solids-containing gasifier effluent gas stream, a primary char material is separated in an external hot primary solids separator. This char is continuously recycled to a lower portion of the fast fluid bed gasification zone via an aerated conduit or standpipe system. Without this char solids recycle feature, a state of fast fluidization would have only transient existence, and the gasifier would degenerate into vertical non-backmixed, dilute-phase solids contact. The combination of high char solids recirculation rate and intense backmixing associated with the fast fluidization phenomena results in substantially isothermal fast fluidized bed gasification zone behavior.

The resulting effluent gas, less the char removed in the primary separator, is passed to an adjacent hot secondary cyclone type solids separator, from which a finer particle size secondary char material is removed.

This secondary char stream from the secondary cyclone separator is continuously recycled to the lower portion of the oxidation zone, where it is injected into the gasifier along with additional steam and air or oxygen.

The cleaned product gas from the secondary cyclone separator is usually fed for reasons of providing increased thermal efficiency to a heat recovery device, such as a waste heat boiler, and then passed to a gas cleanup step which removes any remaining fine, high-ash particulate matter and sulfur compounds. The operating temperature of the clean-up processes used for the particulate matter and sulfur compounds removal usually determines the heat recovery desired for the waste heat boiler.

The gasifier oxidation zone is the vertical region located immediately below the nozzle through which the primary separator char material is recirculated to the gasifier. Thus, the gasifier oxidation zone is contiguous with and lies below the fast fluid bed gasification zone. The fine char withdrawn from the secondary cyclone separator is continuously recycled with steam and injected into the lower portion of the gasifier oxidation zone through a concentric or shrouded injection nozzle. The char and eduction steam are injected vertically into the gasifier through an inner pipe, and a major portion of the total air or oxygen requirement for the gasifier is also injected as an annular or shroud gas stream. The balance of the steam and air or oxygen requirement is fed to the gasifier through an apertured grid located in the lower part of the oxidation zone. The grid is located in the annular space between the gasifier inner wall and the outer wall of the shrouded secondary char reinjection nozzle. Superficial gas velocities used in this annular region are normally similar to those employed in the fast fluidization gasification zone above, i.e. usually exceeding about 5 ft/sec, but may be somewhat less. A provision for withdrawal of oversize spent ash from the lower end of the gasifier is optionally included.

The oxidation zone usually operates at a temperature somewhat higher than in the communicating fast fluid bed gasification zone immediately above; however, it is essential that the oxidation zone operating temperatures are maintained below the ash fusion temperature of the coal being processed. Oxidation zone temperature in the range of 1600°-2000° F. are normally used. Clusters or rivulets of refluxing char particles from the contiguous fast fluidized bed gasification zone immediately above helps moderate the temperatures in the oxidation zone, as does primary recirculated char entering at the top of the oxidation zone. Endothermic steam-$CO_2$-carbon reactions also moderate the highly exothermic combustion reactions which occur in the oxidation zone. These chemical reactions are symbolically represented as equations 4-5 below. Equation 6, also listed below, symbolically represents the slightly exothermic CO shift reaction, which also occurs simultaneously with the other reactions.

$$C+O_2 \rightarrow CO_2 \text{ (highly exothermic)} \quad (4)$$

$$C+\tfrac{1}{2}O_2 \rightarrow CO \text{ (exothermic)} \quad (5)$$

$$H_2+CO \rightarrow H_2+CO_2 \text{ (slightly exothermic)} \quad (6)$$

In addition to the usual advantages of fast fluidized bed gasification, an important added advantage of the present invention is that the secondary cyclone solid char material is recycled to the bottom of the gasifier oxidation zone to increase the percentage carbon conversion and yields of fuel gas products. Also, the annular gasifier oxidation zone surrounding the shrouded char injection nozzle is usually operated at typical fast fluidization superficial gas velocities; i.e., within the range of about 3-15 ft/sec. High-ash containing material can be withdrawn from the lower portion of the oxidation zone if desired.

DESCRIPTION OF PREFERRED EMBODIMENT

Figure 1:
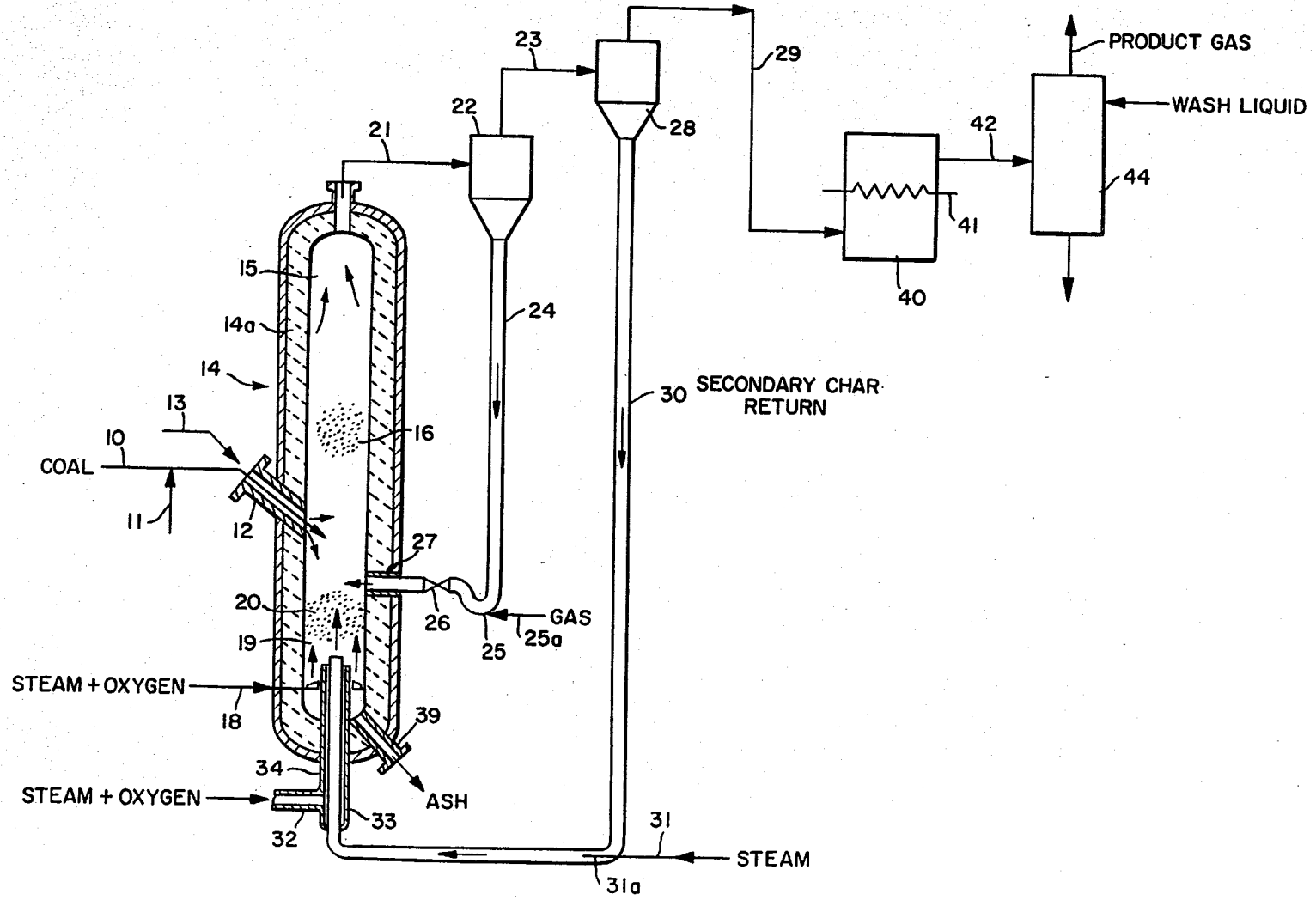
FIG. 1 is a schematic flow diagram showing the essential process steps of the invention utilizing fast fluidized bed gasification of coal.

With reference to FIG. 1, coal feed at 10, such as anthracite or bituminous coal, is normally ground to 18-200 mesh (U.S. Sieve Series) (0.040-0.003 inch) particle size and is fed into fast fluidized bed gasifier assembly 14 having refractory insulation lining 14*a*. The coal is usually introduced with a carrier gas 11 such as recycled product gas through an annular or shrouded nozzle 12 located in the lower portion of gasification zone 15 containing fast fluidized bed 16. The coal feed particles are injected through shrouded nozzle 12 using shroud gas at 13, which can advantageously be recycled product gas. The coal particles are intimately mixed with hot char material in the bed which is maintained in a highly turbulent state of fast fluidization. The weight mixing ratio of the char to coal feed in the fast fluidized bed 16 is at least about 20, and preferably is 22-30, and is a direct consequence of the high solids (char) circulation rates associated with fast fluidized bed contacting and reactions. Steam and oxygen are introduced at 18 into oxidation zone 19 located in the lower portion of the gasifier 14 and containing fluidized bed 20. The fast fluid bed operating temperature is maintained within the range of 1500°-1850° F., and the superficial upward gas velocity is 5-20 ft/sec. Operating pressures of 2-50 atm, (30-750 psig) are usually maintained for the coal gasification operations. The preferred fast fluid bed operating conditions are within the range of 1600°-1800° F. temperature and 3-30 atmospheres pressure.

In the fast fluidized bed 16, individual coal particles undergo rapid devolatilization, which generates gases, tar vapors and char. These tars are thermally cracked to produce light hydrocarbon gases, hydrogen, and carbon during their travel upward through the fast fluid bed gasification zone. A substantial portion of the coal-derived char remains and is recirculated for further reaction. Unconverted steam from a contiguous communicating oxidation zone 19 located below the fast fluid bed gasification zone 15 and carbon dioxide generated therein simultaneously react with the char in the fast fluid bed 16 to produce $H_2$, CO and $CO_2$. The mildly exothermic CO shift reaction to produce additional hydrogen is a third simultaneous reaction occurring in the fast fluid bed gasification zone.

Following the gasification reactions in zone 15, gasifier effluent stream 21 along with substantial char is passed to an external hot primary gas-solids cyclone separator 22, in which the primary char material at 24 is separated from the effluent gas stream 23, which contains some remaining fine char solids. The char in conduit 24 is continuously recirculated to the lower portion of the fast fluid bed gasification zone 15 via an aerated conduit device 25 and control valve 26. Char return conduit 24 is usually somewhat enlarged in diameter so as to provide an adequate inventory of char material in the process and to minimize bridging and other undesired wall effects. An aeration gas such as steam is provided at 25*a* to facilitate recycle of the char solids from 24. The combination of high char solids recirculation rate and intense backmixing associated with fast fluidization phenomena results in substantially isothermal fast fluid bed gasification in zone 15, i.e. not exceeding about 20° F. temperature difference across the bed 16.

From primary separator 22, the resulting effluent gas stream at 23, less the primary char material 24 removed in the primary separator, is fed into a close-coupled, hot secondary cyclone separator 28, in which substantially all the remaining finer particle size char material is removed at 30. This fine secondary char stream 30 is continuously recycled with the aid of steam at 31 injected by nozzle 31*a*, and is introduced into the lower part of the oxidation zone 19. This char is injected vertically into the gasifier along with the steam at 31 and air or oxygen at 32 through a concentric tubular or shrouded nozzle 34. Oxidation zone conditions are maintained at temperature within the range of 1600°–2000° F., and preferably at 1650°–1950° F., and superficial gas velocity of 3–10 ft/sec.

Product gas stream 29 from the secondary cyclone separator 28 is normally passed for thermal efficiency reasons to a heat recovery device 40, such as a waste heat boiler, for heating a process fluid such as steam in passage 41. The cooled gas is then passed to cleanup or wash step 44, which removes any remaining fine, high-ash particulate matter and sulfur compounds such as $H_2S$. The operating temperature of the cleanup steps used for the particulate matter and $H_2S$ removal will usually establish the heat recovery duty of the waste heat boiler 40.

Figure 2:
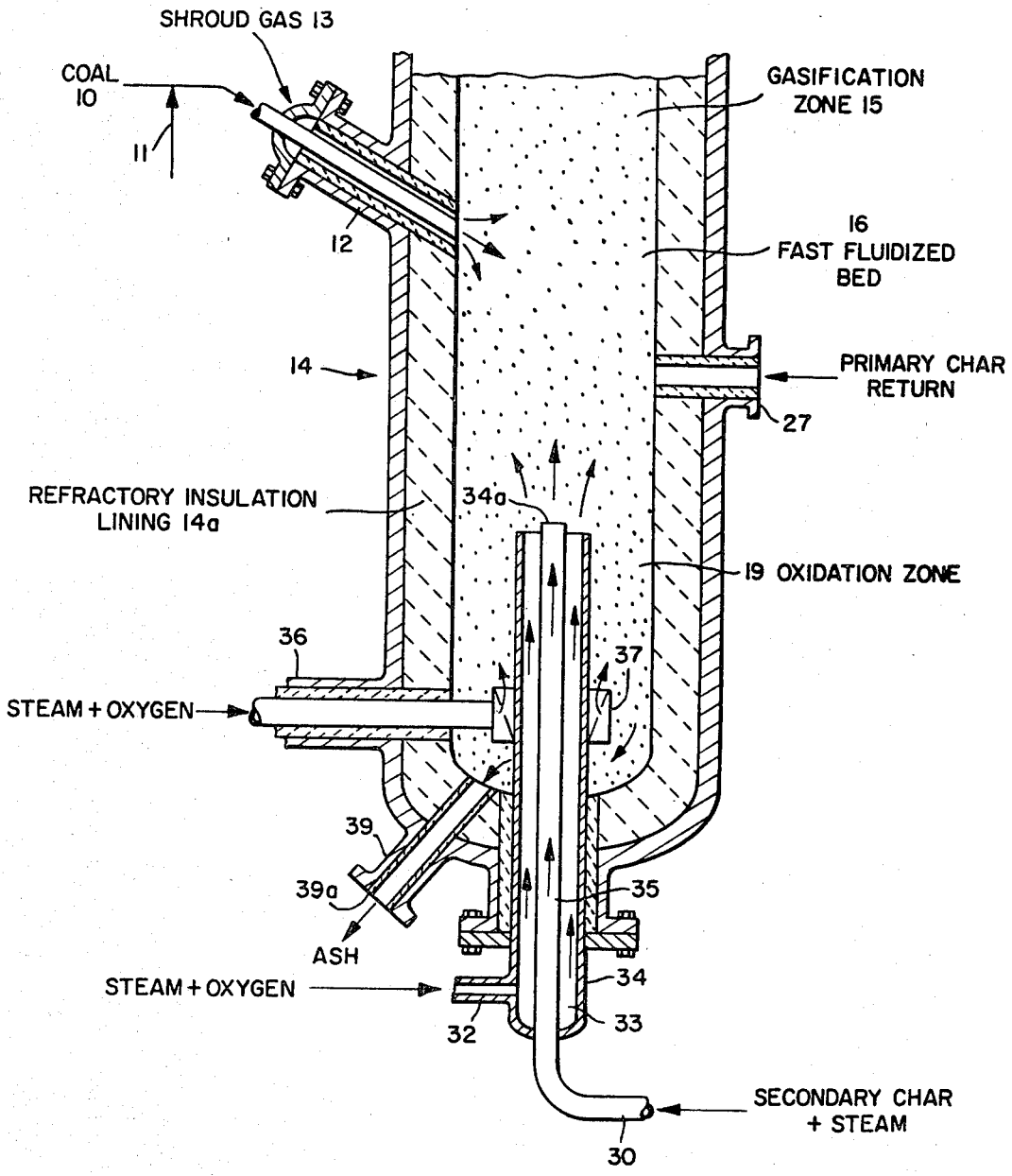
FIG. 2 is a more detailed diagram of the gasifier lower oxidation zone showing the location and configuration of the char solids injection nozzle.

The lower portion of gasifier assembly 14, which has a refractory insulation lining 14*a*, is shown in greater detail in FIG. 2. As shown, the lower oxidation zone 19 of the gasifier assembly 14 is the vertical region located immediately below nozzle 27, through which the primary separator char stream 24 is returned to the gasifier with aeration gas 25*a*. Accordingly, the gasifier oxidation zone 19 is contiguous to and located below the fast fluid bed gasification zone 15. Fine char from the secondary cyclone separator 28 is continuously recycled and injected into the lower portion of the gasifier oxidation zone 19 through the concentric or shrouded injection nozzle 34. The education steam and recycled char jet vertically upward into the gasifier through the inner pipe 35, and a major portion of the total air or oxygen requirement for the process is provided at 32 and is fed as the annular or shroud gas through outer pipe 33. The oxygen provided at 32 is sufficient to consume substantially all of the secondary recycled char to produce carbon monoxide and carbon dioxide by combustion. The remainder of the steam and oxygen or air requirement is fed through conduit 36 and apertured annular-shaped grid 37 located in the lower part of the oxidation zone 19, and which is radially located in the annular space between the gasifier inner wall and the outer wall of secondary char reinjection nozzle 34. The superficial gas velocities used in this oxidation zone 19 are usually somewhat lower than those employed in the fast fluidization bed gasification zone 15. A withdrawal provision for oversize ash particles is optionally provided in oxidation zone 19 as conduit 39.

As noted, the char oxidation zone 19 tends to operate at a temperature somewhat higher than in the communicating fast fluid bed gasification zone 15 above, however, the operating temperatures in zone 19 are maintained below the ash fusion temperature of the coal being processed. Oxidation zone temperatures not exceeding about 2000° F. are normally maintained, and preferably do not exceed 1950° F. Clusters or rivulets of refluxing char particles from the contiguous fast fluid bed gasification zone located above helps to moderate the temperature in the oxidation zone. The endothermic steam-$CO_2$-carbon reactions also moderate the highly exothermic combustion reactions taking place in the oxidation zone.

The location of coal feed nozzle 12 into gasification zone 15 can be varied and should usually be located above the bottom of the reactor by a distance of 0.3–0.6 of the reactor length. The upper end 34*a* of char fines injection nozzle assembly 34 is located below coal feed nozzle 12, and should extend above the lower end of the reactor by a distance of 0.05–0.2 reactor length. The spacing of the upper end 34*a* of carbon fines injection nozzle 34 below feed nozzle 12 is usually varied depending on the caking characteristics or property of the coal being processed, with increased spacing between these nozzles being used for gasifying coals having greater caking properties. The location of primary char return nozzle 27 is usually somewhat above the upper end of nozzle assembly 34. Also, the location of the ash withdrawal conduit 39 should be at the bottom of the reactor and is lined by a refractory material 39*a*.

In the char injection nozzle assembly 34 for recycled char fines, as shown in FIG. 2, the secondary char fines are usually injected from inner pipe 35 at velocity of 3–10 ft/sec. The gas exit velocity from the nozzle annular portion 33 is usually maintained within the range of 5–20 ft/sec, roughly matching that in the gasification zone 15. However, if this shroud gas exit velocity is increased to the range of 20–80 ft/sec, it can advantageously provide a grinding effect on the fluidized bed coal solids and the primary recycled char solids. The grinding effect achieved is in proportion to the kinetic energy dissipation in the form of eddies and interparticle contacts. By providing such a solids grinding capability, the gasifier can be desirably operated at somewhat higher temperature in the oxidation zone without needing to withdraw agglomerated material from the bottom end of the gasifier at connection 39.

This invention is further illustrated by the following example, which should not be construed as limiting the scope of the invention.

EXAMPLE 1

Anthracite coal having properties listed in Table 1 was fed pneumatically into the fast fluid bed primary gasification zone of a fluidized bed gasifier reactor containing a dense phase of circulating char solids. The fast bed reactor size was 8 inches inside diameter by 80 feet long. The operating conditions used and average results obtained without and with recycle of fine char from the secondary cyclone separator are provided in Table 2 below.

TABLE 2

GASIFIER COMPARATIVE PERFORMANCE ON ANTHRACITE COAL FEED

| | Without Secondary Char Recycle | With Secondary Char Recycle | |
|---|---|---|---|
| Feed Streams, lb/hr | | | |
| Coal | 500 | 500 | 330 |
| Air | 1552 | 2337 | 1552 |
| Steam | 232 | 325 | 232 |
| Total Material In | 2284 | 3162 | 2114 |
| FFB Temperature, °F. | 1635 | 1600–1650 | |
| FFB Pressure, psig | 115 | 135 | 135 |
| Fast Bed Superficial Gas Velocity, ft/sec | 8.2 | 9.6 | 9.4 |
| Air/Coal ratio | 3.1 | 4.6 | 4.7 |
| Average, FFB Solids Density (above feed nozzle), lb/ft$^3$ | 16.9 | 17.9 | 17.5 |
| Average Slow Bed Solids Density lb/ft$^3$ | 44 | 41 | 42 |
| Oxidization Zone Temperature, °F. | — | 1625–1675 | |
| Product Streams, lb/hr | | | |
| Hydrogen | 13 | 13 | 8 |
| Carbon Monoxide | 191 | 287 | 189 |
| Carbon Dioxide | 301 | 452 | 298 |
| Methane | 4 | 6 | 4 |
| Hydrogen Sulfide | 2 | 2 | 2 |
| Nitrogen | 1189 | 1807 | 1187 |
| Water Vapor | 279 | 2937 | 278 |
| Char and Ash Dumped from Gasifier, lb/hr | 19 | 178 | 116 |
| Secondary Char Removed, lb/hr | 260 | 0 | 0 |
| Fines in Product Gas, lb/hr | 28 | 47 | 31 |
| Total Material Out, lb/hr | 2284 | 3162 | 2114 |
| Overall Conversion of Carbon, W % | 42 | 63 | 64 |

TABLE 1

TYPICAL ANALYSIS FOR ANTHRACITE COAL FEED

| | Run 170 | Run 200–210 |
|---|---|---|
| Proximate Analysis, W % | | |
| Moisture Content | 0.32 | 2.3 |
| Volatile Matter (DB) | 7.52 | 4.0 |
| Ash (DB) | 11.4 | 10.2 |
| Fixed Carbon (DB) | 81.1 | 85.8 |
| Ultimate Analysis, W % | | |
| Carbon Content (DB) | 78.2 | 84.3 |
| Hydrogen Content (DB) | 0.2 | 2.2 |
| Sulfur Content (DB) | 0.8 | 0.6 |
| Nitrogen Content (DB) | 0.85 | 0.7 |
| Ash (DB) | 11.4 | 10.2 |
| Oxygen via Difference (DB) | 8.6 | 2.0 |
| Sieve Analysis, U.S.S. Mesh, W % | | |
| +20 | 8.5 | 0.00 |
| −20/+50 | 23.6 | 2.60 |
| −50/+70 | 25.4 | 3.25 |
| −70/+100 | 19.2 | 7.4 |
| −100/+140 | 8.9 | 7.4 |
| −140/+200 | 4.7 | 15.35 |
| −200/325 | 5.9 | 20.9 |
| −325 | 3.8 | 43.0 |
| Density, gm/cm$^3$ | 1.7 | — |

Based on the above data, it is seen that substantially increased carbon conversion and yields of hydrocarbon gas product are achieved by recycling the fine char solids from the secondary cyclone separator to the bottom of the oxidation zone for further gasification.

Although this invention has been disclosed in terms of the accompanying drawings and preferred embodiments, it will be appreciated by those skilled in the art that adaptations and modifications of the process may be made within the spirit and scope of the invention, which is defined solely by the following claims.

We claim:

1. A process for gasifying particulate hydrocarbon feed materials to produce a fuel gas product, having low-to-medium heating value, comprising:

(a) introducing the hydrocarbon feed material with steam and oxygen into a gasification zone containing a fast fluidized bed of char particles for gasification therein, said zone being maintained at temperature of 1500°–1850° F., at pressure exceeding about 30 psig, and at upward superficial gas velocity exceeding about 5 ft/sec to heat and gasify the feed and produce a gaseous material;

(b) withdrawing said gaseous material along with char particles from the upper portion of the gasification zone and passing the materials to a primary gas-solids separation step for char solids removal;

(c) withdrawing a first gas stream from said primary gas-solids separation step and returning particulate char solids to the gasification zone;

(d) passing said first gas stream to a secondary gas-solids separation step and removing fine char solids therefrom;

(e) returning the fine particulate char solids from the secondary gas-solids separation step to the lower end of a fluidized bed oxidation zone located immediately below the fast fluidized bed gasification zone; said oxidation zone having temperature maintained within the range of 1600°–2000° F.; and (f) withdrawing a fuel gas product stream from the secondary gas-solids separation step.

2. The process of claim 1, wherein the feed stream is introduced into the gasification zone through a shrouded injection nozzle, and the velocity in the solids injection nozzle is between about 6 and about 100 ft/sec.

3. The process of claim 1, wherein the feed is coal and the weight ratio of gasification zone char to coal is between about 20 and 30.

4. The process of claim 1, wherein the fine char solids from the secondary cyclone separator are returned to the oxidation zone through a gas shrouded nozzle together with an oxygen-containing gas.

5. The process of claim 1, wherein the gasification zone temperature is within the range of 1600°–1800° F., the pressure is 50–750 psig, and the upward superficial gas velocity is 6–20 ft/sec.

6. The process of claim 1, wherein the temperature of the oxidation zone is maintained within the range of 1650°–1950° F.

7. The process of claim 1, wherein the feed material is anthracite coal having particle size within the range of 0.040–0.004 inch (18–140 mesh U.S. Sieve Series).

8. The process of claim 4, wherein the secondary char solids are injected into the oxidation zone at a velocity within the range of 3–10 ft/sec and the shroud gas has exit velocity within the range of 20–80 ft/sec to provide a grinding effect on the char solids.

9. The process of claim 1, wherein the coarse ash particles are withdrawn from the lower portion of the oxidation zone.

10. A process for gasifying coal to produce a fuel gas product, having low-to-medium heating value, comprising:

(a) introducing coal feed into a gasification zone containing a fast fluidized bed of char particles for gasification therein, said zone being maintained at 1500°-1850° F. temperature range, at pressure exceeding about 30 psig and at upward superficial gas velocity exceeding about 5 ft/sec, and a weight ratio of char to coal feed maintained between about 20 to 30 to heat and gasify the coal and produce a gaseous material;

(b) withdrawing said gas and substantial char from the upper portion of the fast fluidized bed gasification zone and passing the materials to a primary gas-solids separation step for char solids removal;

(c) withdrawing a first gas stream from said primary solids separation step and returning particulate char solids to the gasification zone;

(d) passing said first gas stream to a secondary gas-solids separation step and removing a fine char solids therefrom;

(e) returning the fine particulate char solids from the secondary gas-solids separation step through a gas shrouded nozzle into the lower end of a fluidized bed oxidation zone maintained at temperature within the range of 1600°-2000° F. and located immediately below the fast fluidized bed gasification zone; and (f) withdrawing a fuel gas product stream from the secondary gas-solids separation step.

11. The process of claim 10, wherein the percentage conversion of carbon in the coal exceeds about 50 W %.

* * * * *